US007703427B2

(12) United States Patent
Schafer et al.

(10) Patent No.: US 7,703,427 B2
(45) Date of Patent: Apr. 27, 2010

(54) LIFELONG-LUBRICATED CAMSHAFT DRIVE FOR AN INTERNAL COMBUSTION ENGINE

(75) Inventors: Jens Schafer, Herzogenaurach (DE); Martin Steigerwald, Erlangen (DE); Andreas Tholke, Erlangen (DE)

(73) Assignee: Schaeffler KG, Herzogenaurach (DE)

( * ) Notice: Subject to any disclaimer, the term of this patent is extended or adjusted under 35 U.S.C. 154(b) by 544 days.

(21) Appl. No.: 11/577,605

(22) PCT Filed: Sep. 27, 2005

(86) PCT No.: PCT/EP2005/010392

§ 371 (c)(1),
(2), (4) Date: Apr. 20, 2007

(87) PCT Pub. No.: WO2006/045389

PCT Pub. Date: May 4, 2006

(65) Prior Publication Data

US 2008/0047513 A1 Feb. 28, 2008

(30) Foreign Application Priority Data

Oct. 22, 2004 (DE) ..... 10 2004 051 423

(51) Int. Cl.
*F01L 1/02* (2006.01)

(52) U.S. Cl. ..... 123/90.31; 123/90.16; 123/90.37; 464/160

(58) Field of Classification Search ..... 123/90.33, 123/90.34, 90.37, 90.38, 193.5, 193.3, 196 M, 123/90.16, 90.27, 90.31, 90.44; 277/345, 277/348, 351, 352, 652; 464/1, 2, 160; 475/149, 475/150, 331
See application file for complete search history.

(56) References Cited

U.S. PATENT DOCUMENTS

| | | | | |
|---|---|---|---|---|
| 5,680,837 | A | 10/1997 | Pierik | |
| 5,727,508 | A * | 3/1998 | Goppelt | 123/90.17 |
| 6,799,544 | B1 | 10/2004 | Pierik | |
| 2002/0017257 | A1 | 2/2002 | Axmacher et al. | |

FOREIGN PATENT DOCUMENTS

| | | |
|---|---|---|
| DE | 4036209 | 5/1992 |
| DE | 4218081 | 12/1993 |
| DE | 10101669 | 8/2002 |
| DE | 10248355 | 4/2004 |
| EP | 0356162 | 2/1990 |
| EP | 0488156 | 6/1992 |

* cited by examiner

*Primary Examiner*—Ching Chang
(74) *Attorney, Agent, or Firm*—Volpe and Koenig, P.C.

(57) ABSTRACT

A camshaft adjusting device for an internal combustion engine is provided. A functionally reliable camshaft adjusting device designed for a long-lasting operation is obtained when the camshaft adjuster (13) has a lifelong lubrication located in the housing (28, 36, 37) sealed from the surrounding area be sealing covers (36, 37). The camshaft adjuster is not required to be mounted inside the cylinder head (33), but can be mounted as a separate unit on the cylinder head (33) of the internal combustion engine independent of the lubricating oil circuit. This expands, in particular, the range of possibilities for use of the camshaft adjuster (13) with a belt drive.

8 Claims, 2 Drawing Sheets

LIFELONG-LUBRICATED CAMSHAFT DRIVE FOR AN INTERNAL COMBUSTION ENGINE

BACKGROUND

The invention relates to a camshaft drive for an internal combustion engine with a camshaft adjuster.

From DE 689 04 842 T2, a camshaft drive is known for adjusting and fixing the relative rotational angle position of a camshaft relative to a crankshaft of an internal combustion engine by means of a camshaft adjuster. The camshaft adjuster has a housing, which carries on its outer surface a belt pulley. The housing of the camshaft adjuster is closed in a hermetic and airtight way by an end cover on the end opposite the camshaft. The camshaft adjuster is supplied with a fluid, which is used as a work fluid and which takes on lubricating properties, from an oil pan via a motor oil pump.

From DE 102 48 355 A1, a camshaft adjuster is known, which has an adjusting gear mechanism embodied as a triple-shaft gear mechanism with a double-eccentric plate. In this case, the camshaft drive has a toothed chain as a traction mechanism. The camshaft adjuster is integrated into a cylinder head. Also, a control drive is integrated into the cylinder head under a seal. Contact surfaces of components of the camshaft adjuster and anti-friction bearings moving relative to each other are lubricated by means of lubricant present in the cylinder head.

The camshaft adjuster according to DE 100 38 354 C2, which includes a swash-plate gear mechanism, is likewise driven via a toothed chain and integrated into a cylinder head, so that lubrication is realized by means of lubricant present in the cylinder head.

SUMMARY

The invention is based on the objective of providing a camshaft drive, for which the camshaft adjuster can be lubricated in a simple way and for a long service life.

According to the invention, the objective is met by the features of the invention.

Accordingly, the camshaft adjuster features lifetime lubrication. Such lifetime lubrication must be introduced once, e.g., with the production of the camshaft adjuster, into the camshaft adjuster and does not need to be renewed within given maintenance intervals, but instead provides sufficient lubrication for a predefined service life of the camshaft adjuster or the internal combustion engine. The lifetime lubrication involves any selected lubricant, especially grease or oil, which is suitable for this purpose.

Leakage of the lifetime lubrication from the camshaft adjuster, which would lead to a short or long term negative effect on the function of the camshaft adjuster, is prevented according to the invention, in that the camshaft adjuster has a housing, which is sealed from the surroundings and in which the lifetime lubrication is arranged. In this sense, the seal is understood to be any seal that is sufficient to prevent the lubricant from escaping from the housing. The suitable measures for sealing the housing are here to be adapted to the viscosity of the lubricant. In addition, the sealed housing prevents foreign matter such as pollutant particles from entering into the camshaft adjuster.

An essential advantage of the invention is that with the tight housing and the lifetime lubrication, the necessity of connecting the housing to other lubricant circuits is eliminated. Instead, the camshaft adjuster represents, in terms of lubrication, a separate and autonomous component. This has advantages for assembly and disassembly of the camshaft adjuster, because any connections to other lubricant circuits do not have to be taken into account. As another advantage, it is to be noted that if there are ruptures, changes, or contamination in a lubricant circuit of this construction according to the invention, there are no repercussions on the function of the camshaft adjuster. Conversely this means that any negative effects on the function of the camshaft adjuster, which lead to contamination of the lubricant of the camshaft adjuster, cannot lead to a negative effect on a different lubricant circuit. In this way, severe consequential damages, for example, in the area of the cylinder head, can be avoided.

Furthermore, according to the invention it is allowed that the camshaft adjuster does not absolutely have to be arranged in a cylinder head of the internal combustion engine, but instead can be arranged outside of this cylinder head. In this way, expanded structural possibilities are given. For example, such a camshaft adjuster can now be used in connection with a belt drive.

According to a refinement of the camshaft drive according to the invention, the housing has an inner space that is open on at least one side. By means of such a housing, there is easy access for assembly and/or disassembly via the one or more open sides of the inner space. During operation, a seal is realized with a sealing cover, which closes the housing from the outside. Such a sealing cover involves, in particular, a pressed-in or clipped-in sealing cover. The sealing cover can here satisfy only one sealing function at one or more sealing positions, so that this seal can be constructed with small wall thicknesses or non-resistant to bending. Alternatively, such a sealing cover can satisfy other functions in addition to the function of sealing, for example, the support of components of the camshaft adjuster.

For guaranteeing the seal, any components known for this purpose can be used. In particular, it can involve an O-ring, a labyrinth seal, a diaphragm seal, and/or a radial shaft sealing ring. Such sealing measures can guarantee a sufficient sealing function both between stationary components, such as, for example, the housing and a sealing cover, and also between components that move relative to each other. A suitable sealing measure is selected according to the occurring relative velocities, the viscosity of a lubricant, and the sealing position. For example, for sealing positions in the area surrounding rotating components there are, under some circumstances, lower sealing demands due to the centrifugal forces exerted on the lubricant than for sealing positions between components that do not move relative to each other.

According to another construction according to the invention, a camshaft projects from a cylinder head with one end region under a seal. Due to this seal, the camshaft adjuster can be constructed separately from the cylinder head. The housing of the camshaft adjuster is sealed, on the side facing the cylinder head, from the cylinder head, the end area of the camshaft, or a component rotating with the camshaft. In this way, it is guaranteed that no lubricant can escape from the housing of the camshaft adjuster in the direction of the cylinder head and no foreign matter can enter into the housing. For the case that the camshaft can be locked in rotation with a rotating component of the camshaft adjuster projecting from the housing of the camshaft adjuster, it is advantageous when the housing of the camshaft adjuster is sealed from this component. In such a case, the camshaft is sealed separately, for example, from the cylinder head. In this case, the camshaft adjuster is also sealed on the side facing the cylinder head for disassembly of the camshaft. Likewise, the camshaft is sealed from the cylinder head on the outside independent of the assembly of the camshaft adjuster. On the side facing away from the cylinder head, the housing of the camshaft adjuster is sealed from an adjustment shaft of a servo motor (or from a component rotating with the adjustment shaft). In this way, the housing, optionally with sealing covers, the adjustment shaft, and the camshaft, forms an inner space, which is sealed from the outside and in which the gear mechanism of the camshaft adjuster with lifetime lubrication is arranged.

Advantageous refinements emerge from the subordinate claims, the description, and the drawings.

BRIEF DESCRIPTION OF THE DRAWINGS

Additional features of the invention emerge from the following description and the associated drawings, in which embodiments of the invention are illustrated schematically. Shown are.

DETAILED DESCRIPTION OF THE PREFERRED EMBODIMENT

Figure 1:
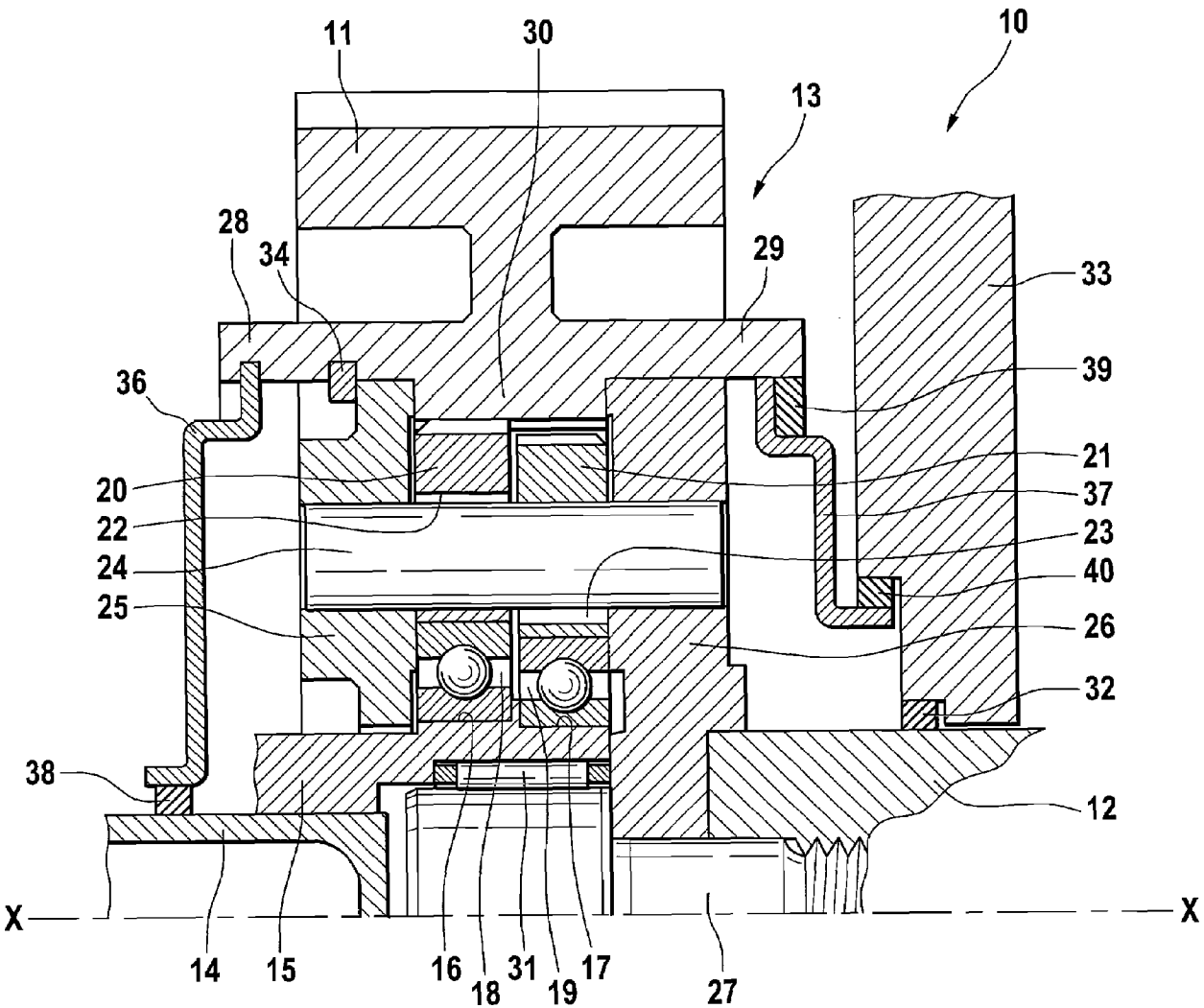
FIG. 1 half-sectional view of a camshaft drive with a housing sealed by means of a sealing cover.
Figure 2:
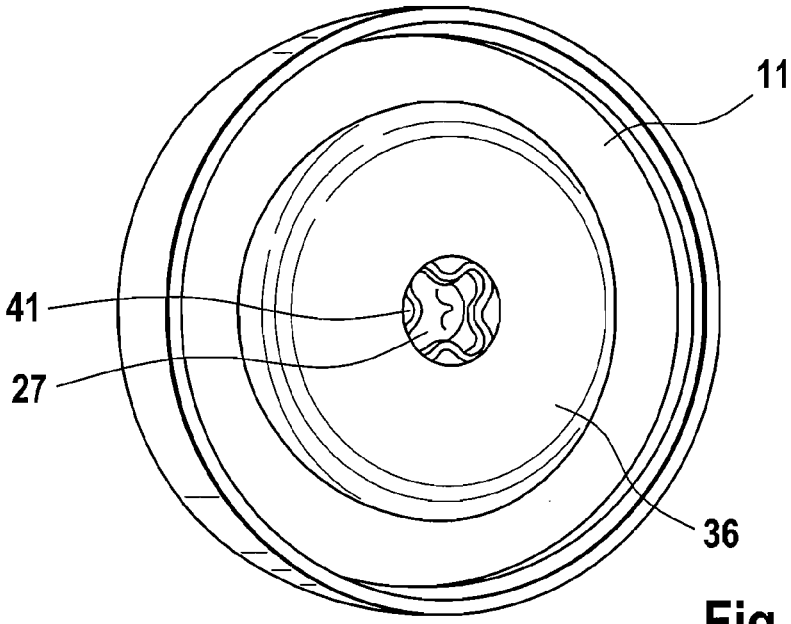
FIG. 2 a front view of the camshaft drive according to FIG. 1 in a three-dimensional representation.
Figure 3:
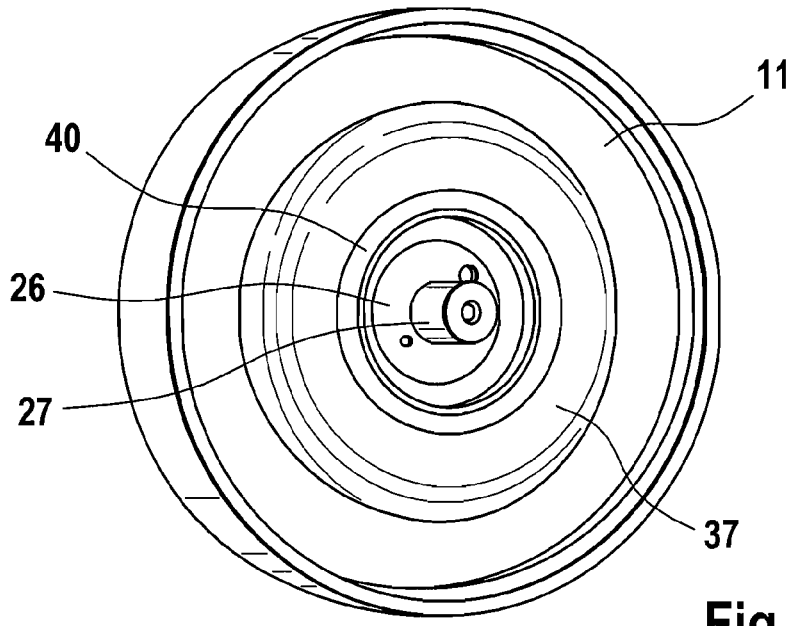
FIG. 3 a rear view of the camshaft drive according to FIG. 1 in a three-dimensional representation.

In the camshaft drive 10 according to the invention, a camshaft adjuster 13 is used for adjusting the angular position between a drive element 11 driven by a traction mechanism, for example, by a chain or a belt, and a camshaft 12 according to a control device, which determines a suitable control signal for adjusting the camshaft adjuster 13, in particular, under consideration of power output demands of the driver, emission requirements, fuel-conservation requirements, and engine, operating, and environmental parameters.

In the camshaft drive 10, any camshaft adjuster can be used, which works on the basis of a superposition gear mechanism or a triple-shaft gear mechanism. In such a gear mechanism, the transmission ratio of the drive movement of the drive element 11 to the camshaft 12 depends on the movement of the adjustment shaft 14, which is drivingly connected to a control drive.

In the embodiment shown in FIG. 1, the gear mechanism involves a double-eccentric gear mechanism. In this embodiment, the adjustment shaft 14 enters into a central bore of a double-eccentric shaft 15 through a drive connection, or optionally through an elastic coupling element 41. In the end region of the double-eccentric shaft 15 projecting past the end of the adjustment shaft 14, there are two axially offset, eccentric peripheral surfaces 16, 17, which each carry an anti-friction bearing 18, 19. The two extremities (regions of maximum distance of the peripheral surfaces 16, 17 from a longitudinal axis X-X of the camshaft adjuster) of the peripheral surfaces 16, 17 are offset by 180° relative to each other in the peripheral direction.

The anti-friction bearings 18, 19 each carry intermediate gears 20, 21 on their outer surfaces. The intermediate gears 20, 21 have several bores 22, 23 distributed in the peripheral direction. A common connecting piece 24 passes through each bore 22, 23, with this connecting piece extending parallel to the longitudinal axis X-X of the camshaft adjuster 13. The connecting piece 24 is supported in its end regions and outside of the intermediate gears 20, 21 in circular ring-shaped support elements 25, 26. The double-eccentric shaft 15 passes with play through the inner bore of the support element 25. The support element 26 is locked in rotation with the camshaft 12 on the inside in the radial direction. For this purpose, the support element 26 is connected with the camshaft 12 via a tensioning screw 27, which is screwed into one end of the camshaft 12.

A housing 28 of the camshaft adjuster 13 has a hollow cylindrical wall 29, which carries on the outside in the radial direction the drive element 11, in particular a belt pulley, and which forms on the inside in the radial direction a ring gear 30. In the region of the extremities of the double-eccentric shaft 15, that is, on opposite peripheral regions, the intermediate gears 20, 21 each mesh with the ring gear 30. In the embodiment shown in FIG. 1, for the intermediate gear 20, the extremity of the peripheral surface 16 is shown, so that the intermediate gear here engages with the ring gear 30. The extremity for the peripheral surface 17 lies in the half-plane not shown in FIG. 1, so that the gearing of the intermediate gear 21 in the shown region does not engage with the internal gearing of the ring gear 30. The bores 22, 23 have an over-dimension relative to the diameters of the connecting pieces, such that relative movements caused by the extremity are possible between the intermediate gears 20, 21 and the connecting piece 24.

Another anti-friction bearing, here a needle bearing 31, is connected between the head of the tensioning screw 27 and the double-eccentric shaft 15. The camshaft 12 emerges from a cylinder head 33 under a seal through a sealing element 32.

The support elements 25, 26 are guided via suitable sliding bearings relative to the housing 28 and are supported on the step for the ring gear 30 on the inside and also in the direction of the X-X axis on the outside by means of suitable securing elements 34.

If the adjustment shaft 14 is driven by the control drive at an angular velocity that deviates from the angular velocity of the camshaft 12, then the extremity and thus the contact point between the intermediate gears 20, 21 travels in the peripheral direction relative to the ring gear 30. In this way, the angle between the drive element 11 and the camshaft 12 is changed.

In terms of additional principle details of the construction of the camshaft adjuster with double-eccentric gear mechanisms, refer to the publication DE 102 48 355 A1 by the applicant.

The contact surfaces moving relative to each other and rolling in opposite directions and also the anti-friction bearings 18, 19, 31 are provided with lifetime lubrication. Leakage of such lifetime lubrication from the housing 28 is prevented by the use of sealing covers 36, 37, which close both openings of the wall 29.

For the embodiment shown in FIG. 1, the sealing covers 36, 37 rotate with the housing 28. The sealing cover 36 is snapped into a suitable groove of the housing 28. On the inside in the radial direction, a sealing element 38 is connected between the sealing cover 36 and the adjustment shaft 14.

A sealing element 39 is connected between the sealing cover 37 and the housing 28. On the inside in the radial direction, the sealing cover 37 has a collar, on which on the inside in the radial direction a sealing element 40 is supported, which is actively connected with the cylinder head 33 on the outside in the radial direction.

For the contact regions of the sealing covers 36, 37 with the adjacent components both on the inside and also on the outside in the radial direction, for example, the following solutions are conceivable alternatively or cumulatively:

The sealing covers 36, 37 can be inserted or snapped into the adjacent components with a non-positive connection. Here, the sealing covers 36, 37 are pressed against the adjacent components through the elasticity of the sealing covers 36, 37 themselves or additional elastic elements, whereby a sealing effect is produced.

Furthermore, the sealing covers can be held by the adjacent components with a positive connection, for example, in a groove.

A sealing element, such as, for example, a sealing ring or a radial shaft sealing ring can be connected between sealing covers 36, 37 and adjacent components.

Furthermore, a diaphragm seal or labyrinth seal can be used, which is adapted to the special operating requirements, such as, rotational speeds, centrifugal forces, and a viscosity of the lifetime lubrication, as well as the occurring temperatures.

The sealing cover 36 is preferably supported in the end region on the outside in the radial direction against the wall 29. Alternatively, a support relative to the support element 25 is possible, wherein in this case an additional seal must be provided between the support element 25 and the wall 29.

On the inside in the radial direction, the sealing cover 36 is supported against the adjustment shaft 14. Alternatively, it is also possible that the sealing cover 36 is supported against the double-eccentric shaft 15. In this case, it is to be guaranteed that the connection between the adjustment shaft 14 and the double-eccentric shaft 15 has a tight construction.

The sealing cover 37 is supported on the outside in the axial direction against the wall 29. Alternatively, it is possible that the sealing cover 37 is supported against the support element 26, wherein in this case, a seal between the support element 26 and wall 29 is to be provided. On the inside in the radial direction, the sealing cover 37 is supported against the cylinder head 33 or the camshaft 12.

For the case that the camshaft 12 and/or the adjustment shaft 14 does not project into the camshaft adjuster 13, but instead is coupled outside of this adjuster to a shaft projecting out of the camshaft adjuster, a seal from this projecting shaft can be realized.

The sealing covers 36, 37 preferably have an inherently stiff construction, for example, as a sheet-metal part. Alternatively, the sealing covers can have a construction that is at least partially not resistant to bending, especially as a sealing bellows, or the like. The sealing covers 36, 37 can be completely left out for a different embodiment of the invention, as long as there is a seal between the housing 28, support element 25, connecting piece 24, double-eccentric shaft 15, and adjustment shaft 14 or housing 28, support element 26, connecting piece 24, and camshaft 12.

According to another construction according to the invention, a rubber-elastic form element 41 is connected between the adjustment shaft 14 and double-eccentric shaft 15. In this case, a seal of a sealing cover 36 from the rubber-elastic form element 41 or from the adjustment shaft can be realized. In some circumstances, it is sufficient in this case to provide a diaphragm seal here, because the lifetime lubrication is accelerated outwards in the radial direction due to centrifugal force.

The camshaft adjuster used according to the invention can involve a camshaft adjuster of any type. For example, as a control unit, a construction with a BLDC motor with rare-earth magnet and fixed stator, preferably with bipolar triggering, can be used. Any other motor, for example, a brush-type direct-current motor, is also conceivable.

Furthermore, camshaft adjuster units, for which the motor rotates with the gear mechanism, can also be used.

A rubber-elastic form element 41 can be integrated into the adjustment shaft 14 as a coupling element between the adjustment shaft 14 and the electric motor, wherein, however, other possibilities, for example, a feather key or a splined shaft profile, can be used. In addition to the described double internal eccentric gear mechanism, other gear mechanisms, for example, single internal eccentric gear mechanisms, swash-plate gear mechanisms, shaft gear mechanisms, planetary gear mechanisms, and other high transmission ratio gear mechanisms can be used in a known way for belt-driven internal combustion engines.

The lifetime lubrication is preferably embodied as a lifetime grease filling. Other lifetime lubrications, such as motor oil (such as the type for gear mechanisms with chain-driven motors) are also conceivable, wherein in this case, increased sealing requirements are to be set.

LIST OF REFERENCE SYMBOLS

10 Camshaft drive
11 Drive element
12 Camshaft
13 Camshaft adjuster
14 Adjustment shaft
15 Double-eccentric shaft
16 Peripheral surface
17 Peripheral surface
18 Anti-friction bearing
19 Anti-friction bearing
20 Intermediate gear
21 Intermediate gear
22 Bore
23 Bore
24 Connecting piece
25 Support element
26 Support element
27 Tensioning screw
28 Housing
29 Wall
30 Ring gear
31 Needle bearing
32 Sealing element
33 Cylinder head
34 Securing element
36 Sealing cover
37 Sealing cover
38 Sealing element
39 Sealing element
40 Sealing element
41 Elastic coupling element

The invention claimed is:

1. A camshaft drive for an internal combustion engine comprising a camshaft adjuster with a housing and a superposition gear mechanism or a triple-shaft gear mechanism in the housing, having a rotatable adjustment shaft drivingly connected to a control drive, a drive element located on a housing of the camshaft adjuster adapted for connection to a crankshaft, and a driven element connected to a camshaft, and the housing is sealed from its surroundings and a lifetime lubrication is arranged in the housing via a first sealing cover located between the housing and the adjustment shaft and a second sealing cover on a cylinder head side that is actively connected to the cylinder head.

2. The camshaft drive according to claim 1, wherein the drive element of the camshaft adjuster is belt-driven.

3. The camshaft drive according to claim 1, further comprising a seal formed via a sealing element comprising an O-ring, a labyrinth seal, a diaphragm seal, and/or a radial shaft sealing ring located on at least one of the first and second sealing covers.

4. The camshaft drive according to claim 1, wherein the housing is constructed in one piece with the drive element.

5. The camshaft drive according to claim 1, wherein the camshaft adjuster is arranged outside of the cylinder head.

6. The camshaft drive according to claim 5, wherein the drive element is a belt pulley.

7. The camshaft drive according to claim 1, wherein the first and second sealing covers are pressed against adjacent components through an elasticity of the sealing covers themselves to produce a sealing effect.

8. The camshaft drive according to claim 1, wherein the first sealing cover is supported against the adjustment shaft via a sealing element.

* * * * *